US008525662B2

(12) United States Patent
Dahlgren et al.

(10) Patent No.: US 8,525,662 B2
(45) Date of Patent: Sep. 3, 2013

(54) OUT OF PRODUCT INDICATOR

(75) Inventors: Aron D. Dahlgren, Minneapolis, MN (US); Christopher D. Diller, Bloomington, MN (US); Nicholas D. Parent, St. Paul, MN (US); Blake R. Otting, Richfield, MN (US)

(73) Assignee: Ecolab USA Inc., St. Paul, MN (US)

( * ) Notice: Subject to any disclaimer, the term of this patent is extended or adjusted under 35 U.S.C. 154(b) by 768 days.

(21) Appl. No.: 12/619,169

(22) Filed: Nov. 16, 2009

(65) Prior Publication Data

US 2011/0114659 A1 May 19, 2011

(51) Int. Cl.

| | |
|---|---|
| ***G08B 23/00*** | (2006.01) |
| ***G08B 21/00*** | (2006.01) |
| ***G07B 11/00*** | (2006.01) |
| ***G09B 21/00*** | (2006.01) |
| ***B65G 25/00*** | (2006.01) |
| ***G01N 15/06*** | (2006.01) |

(52) U.S. Cl.

USPC ..... 340/500; 340/4.13; 340/4.14; 340/540; 414/147; 250/573; 221/6

(58) Field of Classification Search

USPC ..... 340/962, 870.07

See application file for complete search history.

(56) References Cited

U.S. PATENT DOCUMENTS

| | | | |
|---|---|---|---|
| 2,851,791 | A | 9/1958 | Olthuis |
| 3,442,692 | A | 5/1969 | Gaiser |
| 3,676,199 | A | 7/1972 | Hewitt et al. |
| 3,686,025 | A | 8/1972 | Morton |
| 3,701,202 | A | 10/1972 | Compa et al. |
| 3,804,330 | A | 4/1974 | Miller et al. |
| 3,844,478 | A | 10/1974 | Davis |
| 3,870,145 | A | 3/1975 | Mizuno |
| 3,948,387 | A | 4/1976 | Haertle |
| 3,967,008 | A | 6/1976 | Mizuno et al. |
| 4,004,685 | A | 1/1977 | Mizuno et al. |

(Continued)

FOREIGN PATENT DOCUMENTS

| | | |
|---|---|---|
| CA | 1021559 | 11/1977 |
| DE | 2350574 | 4/1974 |

(Continued)

OTHER PUBLICATIONS

ECOLAB Inc., Photos A-C showing Easy Soft™ 12 Fabric Softener 14082, a product similar to a product first publicly disclosed Jun. 1, 2002 and first offered for sale Jun. 5, 2002 differing only in color of the product dispenser and carrier, a product also similar to that shown in Figures 13 and 14 and described on p. 14, line 5 through p. 16, line 9 of U.S. Appl. No. 10/121,440, now U.S. Patent No. 6,883,723 and shown in Figures 13, 14 and 23 and described on p. 16, line 4 through p. 19, line 17 of U.S. Appl. No. 10/411,062, now U.S. Patent No. 6,779,740.

*Primary Examiner* — Steven Lim
*Assistant Examiner* — Pameshanand Mahase
(74) *Attorney, Agent, or Firm* — IPLM Group, P.A.

(57) ABSTRACT

An out of product indicator is provided. The out of product indicator includes a power generator, a sensor and an alarm. The power generator is configured to generate power based on an interaction with at least one aspect of the device it is coupled thereto. The sensor is configured to determine when a product is low. The alarm is coupled to receive power generated by the power generator. Moreover the alarm is activated based on an output of the sensor.

21 Claims, 8 Drawing Sheets

(56) References Cited

U.S. PATENT DOCUMENTS

| | | | | |
|---|---|---|---|---|
| 4,014,010 | A * | 3/1977 | Jinotti | 222/51 |
| 4,014,432 | A | 3/1977 | Clothier et al. | |
| 4,098,937 | A | 7/1978 | Mizuno et al. | |
| 4,105,813 | A | 8/1978 | Mizuno | |
| 4,254,139 | A | 3/1981 | Hendrickson et al. | |
| 4,286,464 | A * | 9/1981 | Tauber et al. | 73/293 |
| 4,567,675 | A | 2/1986 | Rennie | |
| 4,570,888 | A | 2/1986 | Evans | |
| 4,677,760 | A | 7/1987 | St. Louis | |
| 4,753,389 | A | 6/1988 | Davis | |
| 4,840,773 | A | 6/1989 | Wade | |
| 4,891,890 | A | 1/1990 | Church | |
| 5,020,240 | A | 6/1991 | Lee | |
| 5,069,231 | A | 12/1991 | Rutherford | |
| 5,440,976 | A | 8/1995 | Giuliano et al. | |
| 5,658,651 | A | 8/1997 | Smith et al. | |
| 5,787,606 | A | 8/1998 | Bokholdt | |
| 5,869,410 | A | 2/1999 | Smith et al. | |
| 5,943,816 | A | 8/1999 | Hyatt et al. | |
| 5,966,831 | A | 10/1999 | Anderson | |
| 6,006,472 | A | 12/1999 | Holtkamp, Jr. | |
| 6,010,095 | A * | 1/2000 | Hackmeister | 244/134 F |
| 6,110,886 | A | 8/2000 | Scepanski | |
| 6,238,736 | B1 | 5/2001 | Smith et al. | |
| 6,254,932 | B1 | 7/2001 | Smith et al. | |
| 6,305,046 | B1 | 10/2001 | Kingry et al. | |
| 6,581,800 | B2 | 6/2003 | Rodd et al. | |
| 6,779,740 | B1 | 8/2004 | Lentsch et al. | |
| 6,883,723 | B2 | 4/2005 | Griese et al. | |
| 6,887,841 | B2 * | 5/2005 | Mattia et al. | 510/520 |
| 6,899,281 | B1 | 5/2005 | Griese et al. | |
| 6,908,041 | B2 | 6/2005 | Griese et al. | |
| 6,910,640 | B2 | 6/2005 | Griese et al. | |
| 6,910,641 | B2 | 6/2005 | Griese et al. | |
| 7,055,761 | B2 | 6/2006 | Griese et al. | |
| 7,093,771 | B2 | 8/2006 | Griese et al. | |
| 7,093,772 | B2 | 8/2006 | Griese et al. | |
| 7,161,165 | B2 * | 1/2007 | Wirthlin | 250/577 |
| 7,309,026 | B2 | 12/2007 | Griese et al. | |
| 7,311,267 | B2 | 12/2007 | Griese et al. | |
| 2001/0004863 | A1 * | 6/2001 | Simeray et al. | 99/468 |
| 2002/0108969 | A1 | 8/2002 | Rodd et al. | |
| 2003/0024943 | A1 | 2/2003 | MacDonald | |
| 2004/0264304 | A1 * | 12/2004 | Furukawa et al. | 368/223 |
| 2005/0174255 | A1 * | 8/2005 | Horler | 340/870.01 |
| 2007/0159352 | A1 * | 7/2007 | Sahashi et al. | 340/870.07 |
| 2008/0072448 | A1 | 3/2008 | Hubig et al. | |
| 2009/0001192 | A1 | 1/2009 | Griese et al. | |

FOREIGN PATENT DOCUMENTS

| | | | |
|---|---|---|---|
| EP | 1 088 927 | A1 | 4/2001 |
| EP | 1 704 810 | A1 | 9/2006 |
| GB | 1 383 749 | | 2/1975 |
| WO | WO 03/100153 | A1 | 12/2003 |

* cited by examiner

FIG. 2
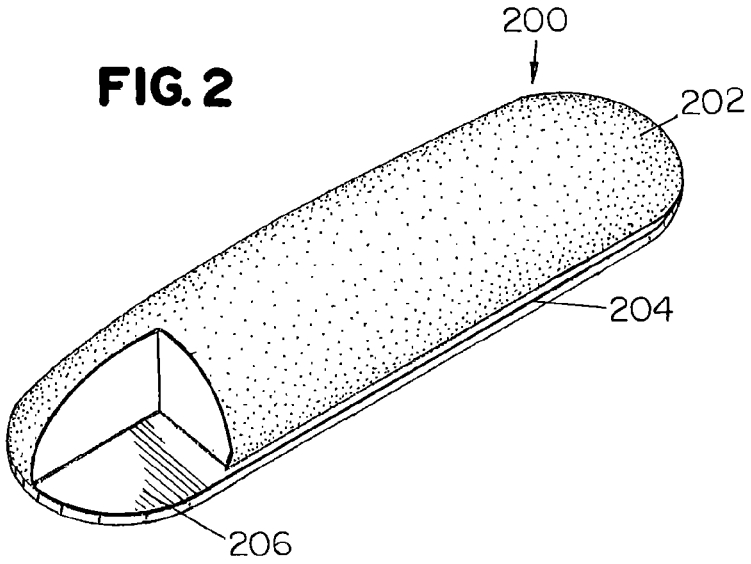
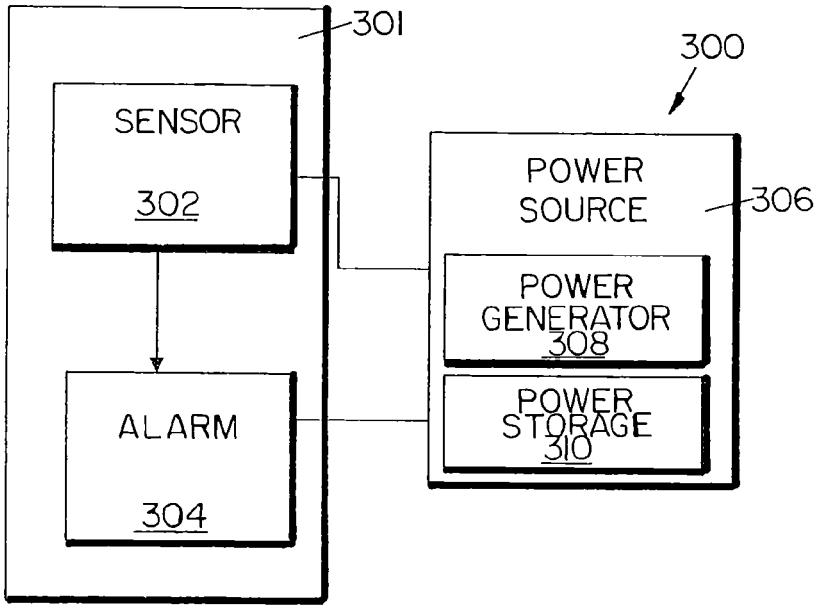
FIG. 3

FIG.4A
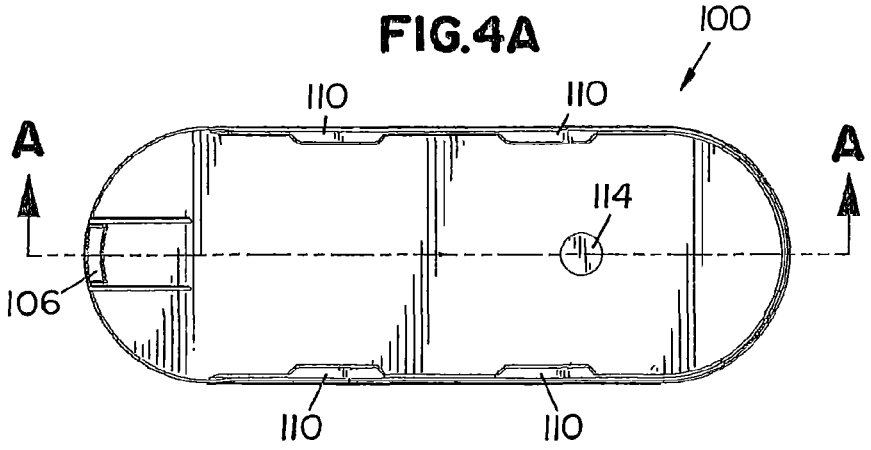
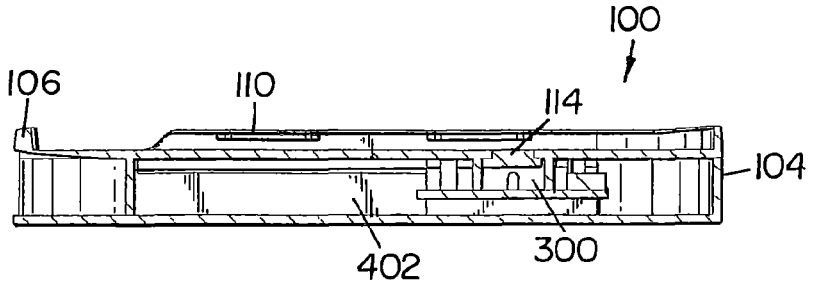
FIG.4B

FIG. 5A
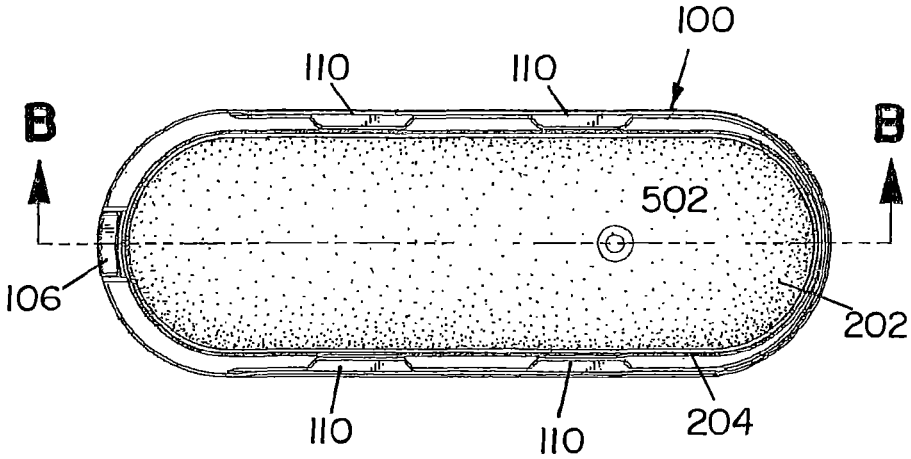
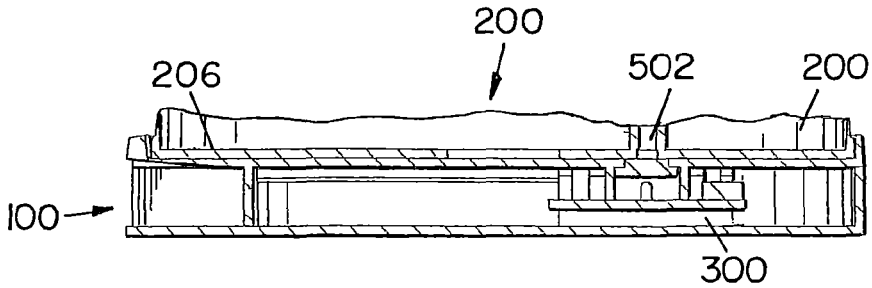
FIG. 5B

FIG.6A
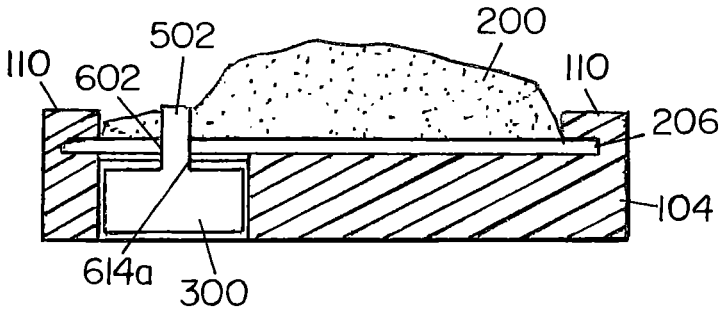
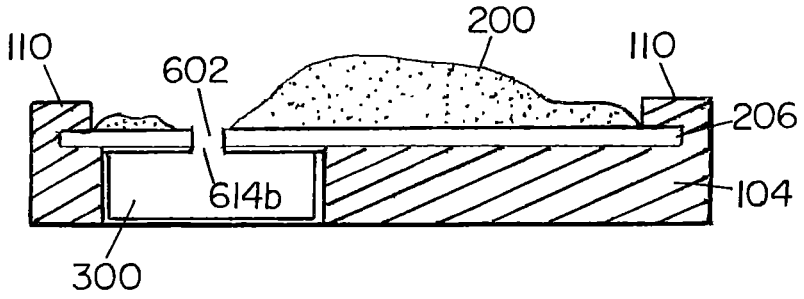
FIG.6B

OUT OF PRODUCT INDICATOR

BACKGROUND

Industrial dryers used in hotels and the like sometimes employ dryer blocks that are mounted inside the dryer to condition fabrics and the like being dried. The dryer blocks condition the fabrics and the like for such reasons as to prevent static, to provided a fabric softener sanitizer, to provide a water repellant, to provide a deodorizer, to provide a bleach, to provide a soil repellant, to provide due-transfer inhibitors, to provide fiber protecting polymers, to provide fiber smoothers, to provide UV light absorbers, to provide anti-wrinkle agents, etc. The dryer blocks include a solid product of select substances that rubs off on the materials as the materials engage the solid product in a rotating drum of the dryer. After a period of time a substantial portion of the solid product is rubbed off and should be replaced.

For the reasons stated above and for other reasons stated below which will become apparent to those skilled in the art upon reading and understanding the present specification, there is a need in the art for a method of indicating to the operator that it is time to replace the solid product.

SUMMARY OF INVENTION

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, an out of product indicator is provided. The out of product indicator includes a power generator, a sensor and an alarm. The power generator is configured to generate power based on an interaction with at least one aspect of the device it is coupled. The sensor is configured to determine when a product is low. The alarm is coupled to receive power generated by the power generator. Moreover the alarm is activated based on an output of the sensor.

BRIEF DESCRIPTION OF THE DRAWINGS

The present invention can be more easily understood and further advantages and uses thereof more readily apparent, when considered in view of the detailed description and the following figures in which:

FIG. 2 is a side perspective view of a product system of one embodiment of the present invention;

FIG. 3 is a block diagram of an out of product indicator of one embodiment of the present invention;

FIG. 4A is a top view of the dispenser of FIG. 1;

FIG. 4B is a cross-sectional side view along line A-A of the dispenser illustrated in FIG. 4A;

FIG. 5A is a top view of a dispenser of another embodiment of the present invention;

FIG. 5B is a cross-sectional side view along line B-B of the dispenser illustrated in FIG. 5A;

FIG. 6A is an end cross-sectional view of a dispenser including a product system of one embodiment of the present invention;

FIG. 6B is an end cross-sectional view of another dispenser including a product system of one embodiment of the present invention;

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that mechanical and electrical changes may be made without departing from the spirit and scope of the present invention. The following detailed description is, therefore, not to be taken in a limiting sense, and the scope of the present invention is defined only by the claims and equivalents thereof.

Figure 1:
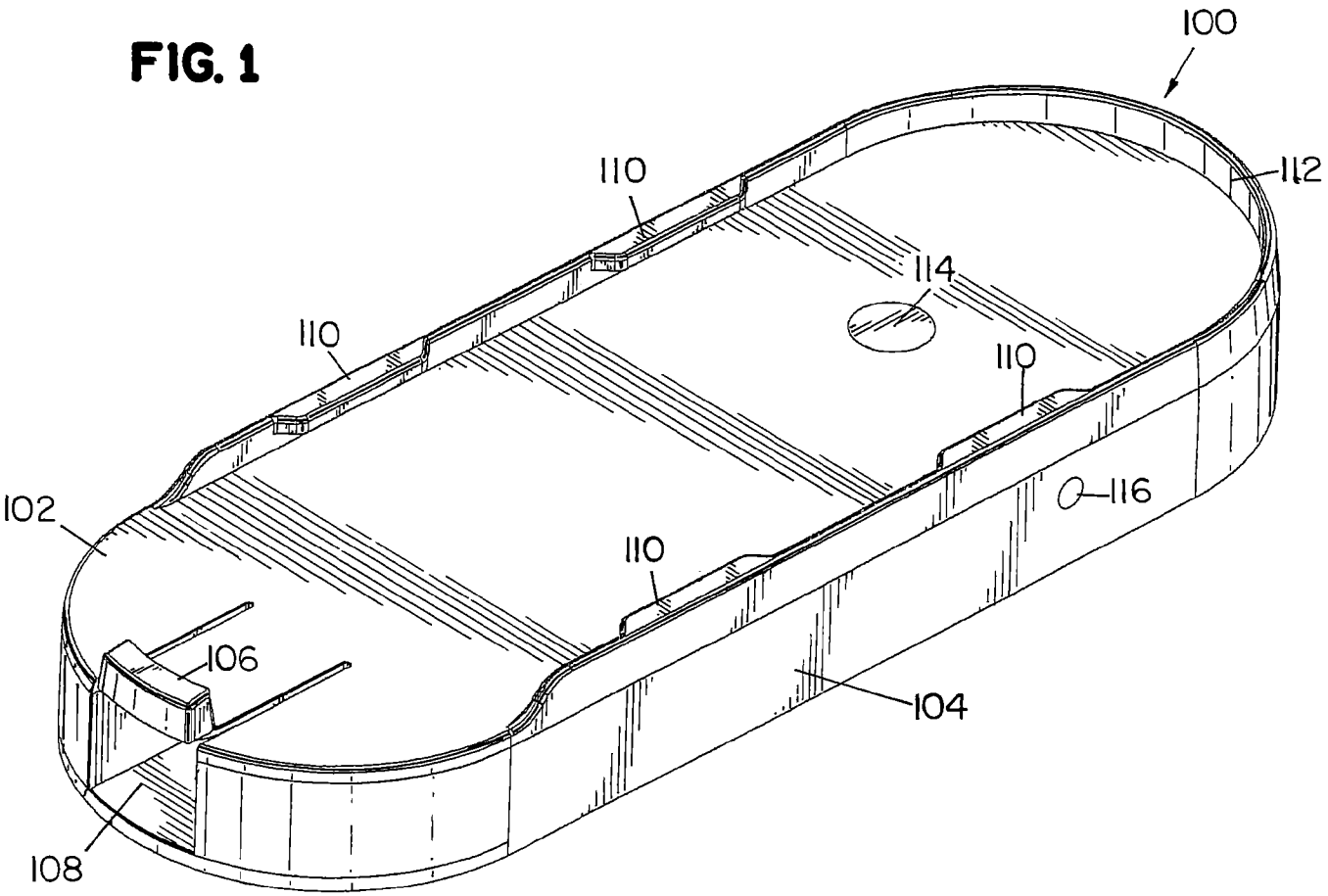
FIG. 1 is a side perspective view of a dispenser of one embodiment of the present invention.

Embodiments of the present invention provide an alarm system that is self powered. In particular, embodiments include a light sensor and alarm that are powered by a power generator. Embodiments of the power generator use an aspect, such as heat or motion, of a device it is mounted to generating power. Referring to FIG. 1, a dispenser 100 of an embodiment is illustrated. The dispenser 100 is adapted to hold a product, such as product 202 of product system 200 illustrated in FIG. 2. Product 202 may be a fabric conditioner used in a dryer or other product that is dispensed during use. The dispenser 100 in this embodiment further includes a support plate 102 upon which a product carrier 206 is supported. Also included are tabs 110 that extend from support rail 112 and a retaining member 106 that retains the product carrier 206 in the dispenser 100. In this embodiment, to load the product 202 in the dispenser 100, the retaining member 106 is depressed into void 108 while edges 204 (mating tabs) of the product carrier 206 are slid in tracks formed by tabs 110. Once the product system 200 is in place, the retaining member 106 is released. The retaining member 106 is made from material that has a biasing force that causes the retaining member 106 to move back to its original location thereby locking the product system 200 on the dispenser when it is released. The structure for coupling the product system 200 to the dispenser 100 is merely an example method. Other methods could be used and the present invention is not limited to a specific method. Moreover, other examples of coupling structures and methods are illustrated in commonly assigned U.S. Pat. No. 7,309,026, issued on Dec. 18, 2007, entitled "Product Dispenser and Carrier," U.S. Pat. No. 6,910,640, issued on Jun. 28, 2005, entitled "Product Dispenser and Carrier," U.S. Pat. No. 6,779,740 issued on Aug. 24, 2004, entitled "Product Dispenser and Carrier," and U.S. Pat. No. 6,883,723 issued on Apr. 26, 2005 entitled "Product Dispenser and Carrier," which are all herein incorporated by reference.

Dispenser 100 of FIG. 1 further includes a housing 104 that houses an out of product circuit 300 (illustrated in FIG. 3). The housing 104 in this example includes a light aperture 114 and an alarm aperture 116. The light aperture 114 is used in conjunction with a light sensor as further described below and the alarm aperture 116 provides a passage upon which an alarm signal can travel to indicate the product 202 has become low. A block diagram of an out of product circuit 300 is illustrated in FIG. 3. The out of product circuit 300 includes an alarm circuit 301 and a power source circuit 306. As illustrated, the alarm circuit 301 includes a sensor 302. In one embodiment the sensor 302 is a light sensor that detects light intensity. When a select predefined light intensity is reached, an alarm 304 of the alarm circuit 301 is activated. Examples of light sensors that could be used include phototransistors and photodarlingtons. In embodiments, the sensor 302 is positioned under the product 202 in the housing 104. Once the product wears away to let enough illumination of light into the sensor 302, the alarm 304 is activated. In one embodiment, the alarm increases in intensity as the more and more product is worn away. The sensor 302 in one embodiment is positioned under the light aperture 114 of the dispenser 100. Moreover, in embodiments, the product carrier 206 has a similar aperture (not shown) so that only the product 202 is between the sensor 302 and any illumination. Illumination is provided in one embodiment when a door to a dryer is opened and light enters the dryer. Hence, in this embodiment, the alarm 304 of the out of product circuit 300 will only be activated when the dryer door is open so that someone is near to hear the alarm. The amount of light needed to activate the alarm can be adjusted in embodiments to achieve a desired activation. Although, the sensor 302 is described as a light sensor above, it will be understood that any type of sensor that can detect when a product is low or out could be used. Therefore, the present invention is not limited to light sensors.

As further illustrated in FIG. 3, the out of product circuit 300 includes a power source circuit 306 for the sensor 302 and the alarm 304 of the alarm circuit 301. In embodiments, the power source circuit 306 includes a power generator 308 that generates energy and a power storage device 310 to store energy generated by the power generator 308. The power generator 308 generates power as the result of its interaction with an aspect of the dryer. Hence, no external power is needed in embodiments to operate the alarm system 300. In one embodiment, the power generator 308 generates power from the motion of a drum of a dryer. In another embodiment, the power generator 308 generates power from heat within the dryer. This power generator 308 embodiment implements a thermoelectric device such as, but not limited to, thermocouples, thermopiles and Peltier Effect devices to generate power. The power generator 308 embodiment using the motion aspect of the drum to generate power is further described in relation to FIG. 9 described below.

FIG. 4A further illustrates a top view of dispenser 100. FIG. 4B illustrates a cross-sectional side view of the dispenser 100 along line A-A. This view illustrates the out of product circuit 300 positioned within the housing 104. As illustrated, the housing 104 forms a cavity 402 in which the out of product circuit 300 is housed. Also illustrated is light aperture 114 that is positioned to let light enter the sensor 302 of the out of product circuit 300. FIGS. 5A and 5B further illustrate a dispenser 100 having a product system 200 mounted thereon. In particular, FIG. 5A illustrates a top view of a dispenser 100 and a product system 200. FIG. 5A also illustrates another embodiment that includes a light pipe 502 to direct light into the sensor 302. In FIG. 5B, a cross-sectional side view of the dispenser 100 and product system 202 along line B-B of FIG. 5A is illustrated. In this view the function of the light pipe 502 is illustrated. As illustrated, in this embodiment, the light pipe 502 allows light to enter the alarm system 300 even though all of the product 202 has not been worn down to the support plate 102 of the product carrier 206. The remaining product 202 in this embodiment may be unusable because in some embodiments it will be flush with or below walls of the dispenser 100. The height of the light pipe 502 extends a select distance from the support plate 102 of the product carrier 206. The select distance is such that the light pipe 502 becomes exposed when the useable product 202 has worn away. FIG. 6A illustrates a cross-sectional end view of an embodiment using a light pipe. FIG. 6A illustrates, in this embodiment, the light pipe 502 is part of the product carrier 206. The light pipe 502 aligns with a light aperture 614A of the support plate 102 of the dispenser 100. Also illustrated in FIGS. 6A and 6B is that the light aperture 614A and 614B is in a different location in the support plate than the embodiment illustrated in FIG. 1. Hence, the present invention is not limited to a specific location regarding the light aperture. FIG. 6B illustrates a cross-sectional end view of an embodiment using just a light aperture 614B. As illustrated in this embodiment, the product carrier 206 includes a carrier aperture 602 that aligns with the light aperture 614B in the support surface 102. Although, only one light aperture 614A and associated light pipe 502 is illustrated, more than one light aperture and associated light pipe could be used. For example, in an embodiment, multiple light apertures each having an associated light pipe of a different height is used to indicated product levels at different stages of use. For example, a first aperture with an associated first light pipe that is relatively tall could indicate that 50% of the product is left, a second aperture with an associated second light pipe that is relatively short (or none at all) could indicate the product is out and a third aperture with an associated third light pipe that has a height between the first and second light pipes could indicate that 25% of the product is left.

Figure 7:
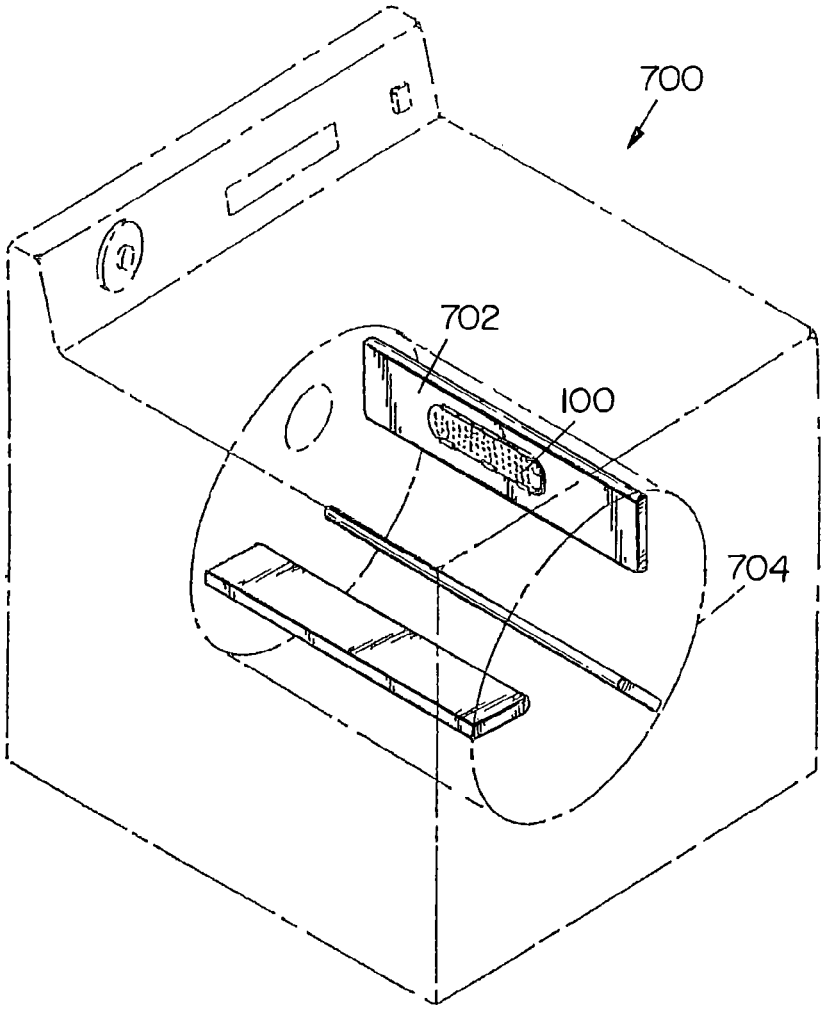
FIG. 7 is a side perspective view of a dryer having a dispenser of one embodiment coupled thereto.

The dispenser 100 in one embodiment is mounted to a dryer fin 702 mounted to a drum 704 of a dryer 700 as illustrated in FIG. 7. As briefly discussed above, the movement of the dryer fin 702 causes the power generator 308 of the alarm system 300 to generate power. Although, the dispenser 100 is illustrated as being mounted on a dryer fin 702 it can also be mounted on any surface that moves such as, but not limited to, the drum 704 of the dryer 700. The power generated is then used to operate the alarm circuit 301. An example of an alarm circuit 301 in an embodiment is illustrated in the schematic diagram of FIG. 8. This example alarm circuit 301 includes a first rail 802 and a second rail 804. A power supply, such as power supply circuit 306, provides power to the alarm circuit 301 via the first rail 802 and the second rail 804. In particular, the first rail 802 is coupled to Vcc and the second rail 804 is coupled to ground of the power supply circuit 306. In this embodiment a switch 806 is placed in the first rail 802 to selectively turn on and off the alarm circuit 301. A phototransistor 808 and a variable resistor 810 are coupled across the first and second rails 802 and 804. In particular, a collector of the phototransistor 808 is coupled to the first rail 802 and an emitter of the phototransistor 808 is coupled to a first end of the variable resistor 810. A second end of variable resistor 810 is coupled to the second rail 804. The activation portion of the variable resister 810 is coupled to a first node 830 that is coupled to the connection between the emitter of the phototransistor 808 and the first end of the variable resistor 810. The variable resistor 810 (potentiometer) is used to tune the light threshold at which the alarm 824 is activated. First node 830 is coupled to a second input 816B of a comparator 816. The comparator 816 is part of a comparator circuit LM339A. Comparator circuit LM339A is known in the art and is made by various manufactures. Another part of the LM339A is part 818 which indicates power and ground pins that are coupled across the first rail 802 and the second rail 804 respectively. A first resistor 812 and a second resistor 814 are further coupled in series across rail 802 and rail 804. A second node 832 is coupled between the first and second resistors 812 and 814. The second node 832 is coupled to a first input 816A to the comparator 816. An output 816C of the comparator 816 is coupled to a base of transistor 822. A third resistor 820 is coupled across rail 802 and the base of transistor 822. A collector of transistor 822 is coupled to the first rail 802. An emitter of transistor 822 is coupled to first input to a speaker 824. A second input to speaker 824 is coupled to the second rail 804.

Figure 8:
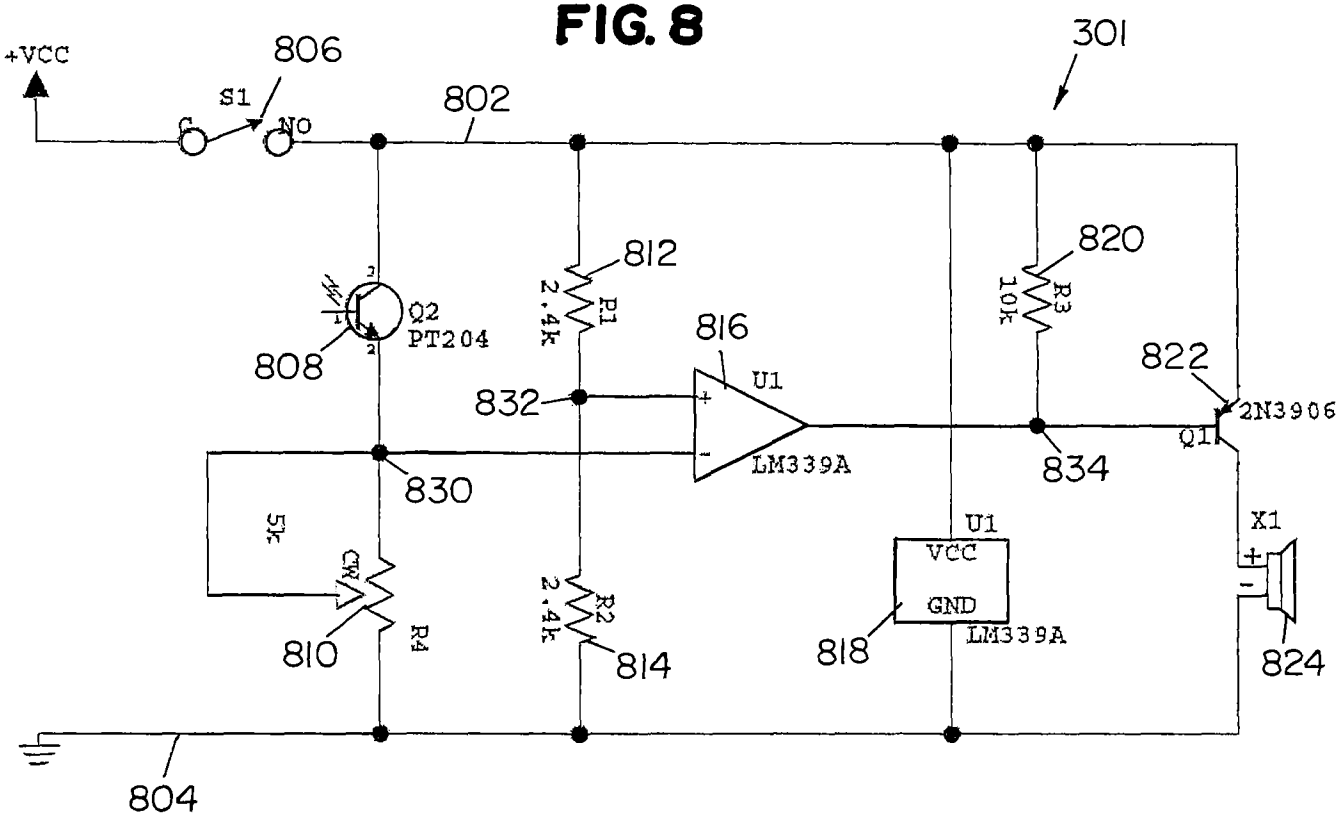
FIG. 8 is a schematic diagram of an alarm system of one embodiment of the present invention.

In operation, when switch 806 is closed and select amount of light (dependant of the sensitivity of the phototransistor 808) hits the phototransistor 808, the base of the phototransistor 808 is activated to allow current from the first rail 802 to pass through the collector and emitter of the phototransistor 808 to node 830. The comparator 816 compares the voltage difference between nodes 830 and node 832. When a select difference is detected, a signal is output from output 816C of the comparator 816. The output signal from output 816C of the comparator 816 causes the base of transistor 822 to pass current from the first rail 802 through the emitter and collector of transistor 822 thereby powering the alarm 824, which in this embodiment is a speaker. Although a speaker 824 is used as an alarm in this embodiment to generate a sound, other types of alarms could be used, such as but not limited to, lights. The circuit of FIG. 8 is only an example of an alarm circuit 301. Any type of circuit that is activated upon the detection of light can be used. Hence, the present invention is not limited to a specific circuit. Moreover, in some embodiments the alarm intensity is increased with an increase of light intensity. This is accomplished by operating a transistor in an "active" mode instead of a "saturation mode" or with the use of a photo-resistor.

Figure 9:
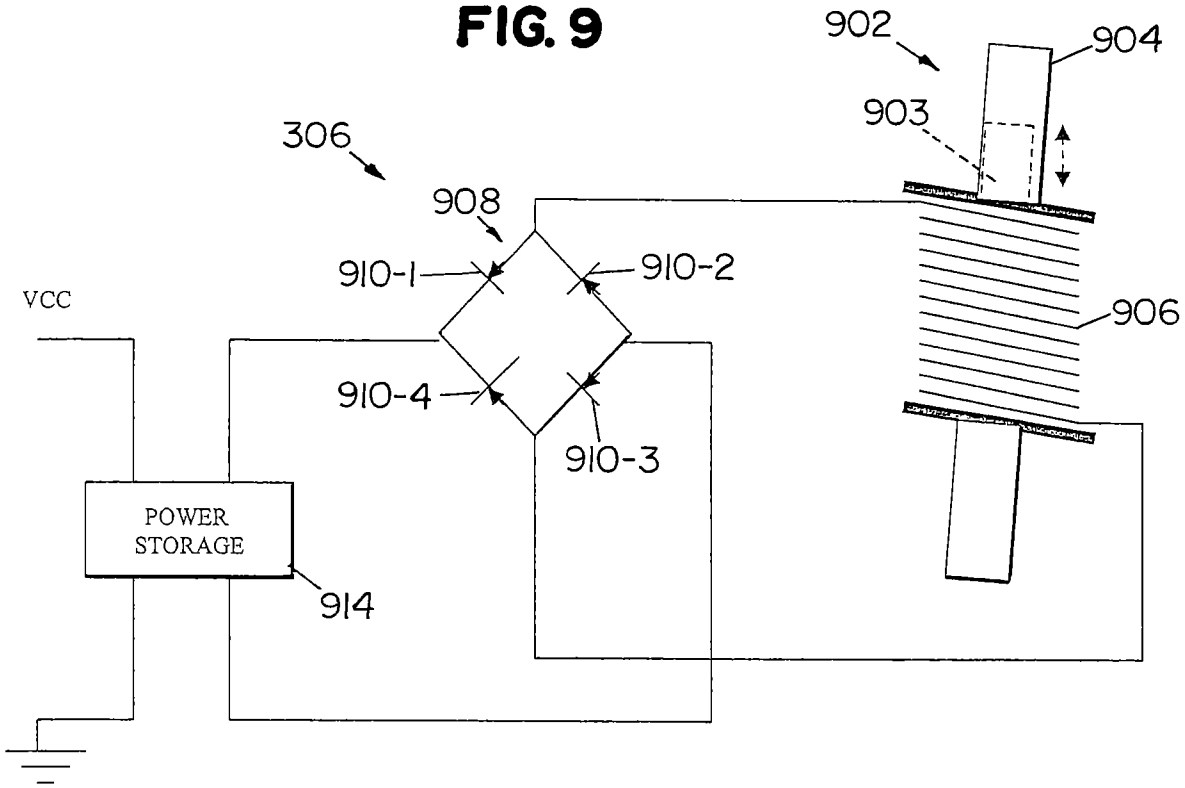
FIG. 9 is a schematic diagram of a power generator of one embodiment of the present invention.

Referring to FIG. 9, an example power source 306 schematic diagram of an embodiment is illustrated. This embodiment uses a magnet 903 contained in a bobbin 904 that passes through a conductive coil 906. In particular, the motion of the drum 704 of the dryer 700 rotating is used to pass the magnet 904 that is in the bobbin 904 back and forth through the conductive coil 906. An electromagnetic field (EMF) is generated each time the magnet 904 passes through the coil 906 according to Faraday's law of magnetic induction which is $\epsilon = -N d\Phi/dt$. Where N is the number of coil loops and $\Phi$ is the magnetic flux in webers. The EMF creates current pulses or AC signals. The current pulses are applied to a power storage device 914 such as a rechargeable battery, capacitor, super capacitor etc. In the embodiment of FIG. 9, a full bridge rectifier 908 is used to convert AC signals formed by the EMF pulses into a DC signal used to charge the power storage device 914. The full bridge rectifier 908 in this embodiment includes diodes 910-1 through 910-4. The power storage device 914 is coupled to provide power to the alarm circuit 301. The size of the magnet 903, the length of bobbin 904 and the number of coils 906 in the power source 306 are selected based on a desired output of power needed for the alarm circuit 304 and the sensor 302. In one embodiment, the power circuit 306 includes more than one set of coils, magnets and bobbins 904. Power source 306 as described above is merely an example of a power source circuit that could be used. Any power source circuit using motion, such as but not limited to, the motion provided by a dryer to generate power could be used. Moreover, any power source circuit using heat such as, but not limited to, thermoelectric devices and Peltier devices and the like could be used. Hence, the present invention is not limited to a specific power generating circuit.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. An out of product indicator comprising:

a dispenser configured to selectively hold a solid product that wears away during use, the dispenser including a housing;

a power generator configured to generate power based on an interaction with at least one aspect of a device it is coupled thereto;

a sensor configured and arranged to generate an output signal when the product is low and a door of the device allowing access to the out of product indicator is opened; and an alarm coupled to receive power generated by the power generator, the alarm being activated based on a generated output signal of the sensor.

2. The out of product indicator of claim 1, wherein the power generator is a thermoelectric device.

3. The out of product indicator of claim 1, wherein the power generator is a Peltier device.

4. The out of product indicator of claim 1, further comprising:

a power storage device configured to store power generated by the power generator, the alarm coupled to receive power from the power storage device.

5. The out of product indicator of claim 4, further comprising:

the sensor coupled to receive power from the power storage device.

6. The out of product indicator of claim 1, wherein the power generator further comprises:

a magnet; and a coil, the magnet configured to pass through the coil based on the movement of the device to generate electromagnetic field (EMF) pulses.

7. The out of product indicator of claim 6, further comprising:

a full bridge rectifier circuit coupled to convert an alternating current (AC) signal from the EMF pulses into a direct current (DC) signal used to charge a power storage device.

8. The out of product sensor of claim 1, wherein the sensor is a sensor selected from a group consisting of a phototransistor and a photodarlington.

9. The out of product sensor of claim 1, wherein the alarm is an alarm selected from a group consisting of a speaker to produce a sound and a light to produce a light signal.

10. The out of product sensor of claim 1, further comprising:

a dispenser including a housing, the housing having a first surface and an opposed second surface, the first surface of the housing configured to selectively hold the product, the second surface configured to be mounted to a portion of the device, the power generator, the sensor and the alarm received in the housing.

11. An out of product sensor comprising:

a dispenser configured to selectively hold a solid product that wears away during use, the dispenser including a housing;

a sensor received in the housing, the sensor configured to monitor the solid product and produce a signal when the product is low;

an alarm received in the housing, the alarm configured to indicate when the sensor has sensed a low product; and a power generator received in the housing, the power generator configured to power the sensor and the alarm, the power generator configured to generate power based on the movement of a device the dispenser is mounted thereto.

12. The out of product sensor of claim 11, wherein the sensor is a sensor selected from a group consisting of a phototransistor and a photodarlington.

13. The out of product sensor of claim 12, wherein the dispenser further includes a light aperture that provides a light passage between the product and the sensor.

14. The out of product sensor of claim 1, further comprising:

a light pipe providing a light passage to the sensor in the housing, the light pipe extending from a support plate of the dispenser that holds the solid product, the light pipe extending a select distance from the support plate so that light will enter the light pipe even though not all of the solid product is worn away from the support plate.

15. The out of product sensor of claim 11, wherein the alarm is an alarm selected from a group consisting of a speaker to produce a sound and a light to produce a light signal.

16. The out of product sensor of claim 11, wherein the power generator further comprises:

a magnet; and a coil, the magnet configured to pass through the coil based on the movement of the device thereby generating electromagnetic field (EMF) pulses.

17. The out of product indicator of claim 16, further comprising:

a full bridge rectifier circuit coupled to convert an alternating current (AC) signal from the EMF pulses into a direct current (DC) signal; and a power storage device coupled to be charged from the DC signals.

18. The out of product indicator of claim 17, wherein the power storage device is a power storage device selected from a group comprising a battery, a capacitor and a super capacitor.

19. An out of product indicator comprising:

a dispenser having a first surface configured to selectively hold a solid product that wears away during use and a second surface configured to be mounted to a device that moves, the dispenser further including a housing;

a sensor received in the housing, the sensor configured to monitor the product and produce a signal when the product is low and a door allowing access to the device is opened;

an alarm received in the housing, the alarm configured to indicate when the sensor has sensed a low product;

a power storage device coupled to provide power to the sensor and the alarm; and a power generator received in the housing, the power generator configured to charge the power storage device, the power generator configured to generate power based on the movement of the device the dispenser is mounted thereto.

20. The out of product dispenser of claim 19, wherein the power generator further comprises:

a magnet;

a coil, the magnet configured to pass through the coil based on the movement of the device to generate electromagnetic field (EMF) pulses; and a full bridge rectifier circuit coupled to convert an alternating current (AC) signals from EMF pulses into a direct current (DC) signal to charge the power storage device.

21. The out of product dispenser of claim 19, wherein the second surface of the dispenser is configured to be mounted on a moving portion of a dryer.

* * * * *